US007064485B2

(12) United States Patent
Kimura et al.

(10) Patent No.: US 7,064,485 B2
(45) Date of Patent: Jun. 20, 2006

(54) PHOTOMULTIPLIER TUBE HAVING FOCUSING ELECTRODES WITH APERTURES AND SCREENS

(75) Inventors: Suenori Kimura, Hamamatsu (JP); Takayuki Ohmura, Hamamatsu (JP); Teruhiko Yamaguchi, Hamamatsu (JP); Masuo Ito, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 115 days.

(21) Appl. No.: 10/807,334

(22) Filed: Mar. 24, 2004

(65) Prior Publication Data

US 2005/0212421 A1 Sep. 29, 2005

(51) Int. Cl.
*H01J 43/18* (2006.01)
*H01J 43/04* (2006.01)

(52) U.S. Cl. ..... 313/533; 313/532; 313/535; 313/103 CM; 313/105 CM; 250/214 VT

(58) Field of Classification Search ..... 313/532–534, 313/103 CM, 105 CM, 387, 542, 103 R; 250/207, 214 VT; 330/42; 315/341
See application file for complete search history.

(56) References Cited

U.S. PATENT DOCUMENTS

| | | | | |
|---|---|---|---|---|
| 4,777,403 | A * | 10/1988 | Stephenson | 313/533 |
| 5,416,382 | A | 5/1995 | L'Hermite | 313/532 |
| 5,598,060 | A | 1/1997 | L'Hermite | 313/532 |
| 5,689,152 | A | 11/1997 | Boutot et al. | 313/532 |

FOREIGN PATENT DOCUMENTS

| | | |
|---|---|---|
| JP | C2 118794 | 1/1937 |
| JP | A 6-111757 | 4/1994 |
| JP | A 06-150876 | 5/1994 |
| JP | A 7-192686 | 7/1995 |
| JP | A 07-192686 | 7/1995 |
| JP | A 07-245078 | 9/1995 |
| JP | A 08-017389 | 1/1996 |
| JP | A 8-306335 | 11/1996 |
| JP | A 11-250853 | 9/1999 |

* cited by examiner

*Primary Examiner*—Joseph Williams
*Assistant Examiner*—Bumsuk Won
(74) *Attorney, Agent, or Firm*—Oliff & Berridge, PLC

(57) ABSTRACT

A glass container has a faceplate, a side tube, and a bottom. A photocathode is formed on the inner side of the faceplate. The glass container includes a first dynode, a second dynode, a screen focusing electrode, a dynode array, and an anode. The screen focusing electrode consists of a first screen, a second screen, a flat plate, and an aperture. The first screen is provided on the first dynode side of the aperture and extends across the lower end of the first dynode towards the photocathode. The second screen is provided on the second dynode side of the aperture and extends across the lower end of the second dynode towards the photocathode. A Venetian blind type is provided as the dynode array. The first dynode, the second dynode, the dynode array, and the anode are maintained at the potential which is higher than that of the photocathode. Electrons emitted from the photocathode in response to incident light thereon efficiently impinge on the dynodes regardless of where the electrons are emitted. The electrons are multiplied and then detected by the anode.

8 Claims, 12 Drawing Sheets

PHOTOMULTIPLIER TUBE HAVING FOCUSING ELECTRODES WITH APERTURES AND SCREENS

TECHNICAL FIELD

The present invention relates to a photomultiplier tube.

BACKGROUND ART

The Japanese Patent Unexamined Application publication 6-111757 (designated as Document 1 hereinbelow) describes a photomultiplier with N number of independent electron multiplying portions disposed around a center axis. The photomultiplier includes a hermetically sealed container having a symmetrical structure along the longitudinal axis. The photomultiplier has a photocathode formed on the inner surface of the hermetically sealed container and a first dynode. The first dynode divides photoelectrons emitted from the photocathode into the N number of electron multiplying portions in accordance with the position on the photocathode which emits the photoelectron.

The first dynode has a cup shape with a flat bottom and a side face that extends towards the photocathode. The first dynode has a symmetric axis which substantially coincides with the longitudinal axis of the hermetically sealed container. The electron multiplying portion consists of sheet-type electron multipliers. An electrode is provided near a center on the bottom of the first dynode, and is maintained at the substantially same potential as that of the photocathode.

The Japanese Patent Unexamined Application publication 7-192686 (designated as Document 2 hereinbelow) describes a photomultiplier tube with at least two space segments. This photomultiplier tube has a hermetically sealed container with a photocathode being formed inside The hermetically sealed container includes a portion corresponding to a focusing electrode for focusing photoelectrons emitted from the photocathode and another portion corresponding to a first dynode performing the initial multiplication of photoelectrons.

The portion corresponding to the focusing electrode is separated from the portion corresponding to the first dynode by a flat plate. The flat plate has holes corresponding to each segment. The hole has a grid. A center partitioning wall having a flat surface that includes the center axis of the hermetically sealed container is provided on the opposite side to the side of the flat plate facing the photocathode. A second and higher order input dynodes are provided in the vicinity of the opposite side to the side of the center partitioning wall that faces the photocathode. A transverse rod is positioned at the center of the hermetically sealed container that includes the center axis. And the rod is parallel and distant away from the flat plate. The transverse rod is insulated from the electrode and maintained at the potential that is identical or similar to that of the photocathode.

The Japanese Patent Unexamined Application Publication 8-306335 (designated as Document 3 hereinbelow) describes a multi-channel type electron multiplier tube. The electron multiplier tube is provided with sheet-like dynodes having control electrodes between dynode sheets to control the gain of specific channels.

This multi-channel electron multiplier tube is provided with a hermetically sealed container having a photocathode on the inner surface, and cross-shaped projections between each channel. These projections are maintained at the same potential as that of the photocathode.

The Japanese Patent Unexamined Application Publication 11-250853 (designated as Document 4 hereinbelow) describes a photomultiplier tube in which an electron convergence space is divided into a plurality of segments by a partition plate. The partition plate in this photomultiplier tube extends from a position near the photocathode formed on the inner surface of the hermetically sealed container to the surface that includes the center axis of the hermetically sealed container. The partition plates have the same potential as the photocathode. Each segment is provided with a plurality of dynodes for multiplying electrons.

DISCLOSURE OF THE INVENTION

The first dynode in the photomultiplier tube described in Document 1 has a cup shape. An electrode disposed near the center of the bottom of the first dynode is maintained at the same potential as that of the photocathode and is used to adjust the electric field inside the photomultiplier tube, thereby ensuring that electrons emitted from the photocathode and secondary electrons emitted from the first dynode impinge on the first dynode and other higher order dynodes which are sheet types.

The photomultiplier described in Document 2 has an electrode that functions as the focusing electrode and the first dynode to cause electrons emitted from the photocathode to impinge on the first dynode. Secondary electrons emitted from the first dynode are guided to the second and higher order input dynodes by using the effects of the center partitioning wall and potential differences between the first dynode and the second and higher order input dynodes.

In the photoelectron multiplier tube described in Document 3, a control electrode is provided between the dynode sheets in order to control the gain of specific channel of the sheet type dynode. Cross-shaped projections with the same potential as that of the photocathode are provided between each channel to cause electrons to impinge on the dynodes.

In the photomultiplier described in Document 4, a partition plate with the same potential as that of the photocathode is disposed between a plurality of segments to adjust the electric field inside the photomultiplier, thereby causing electrons to impinge on the dynodes.

However, electrons emitted from some areas of the photocathode in the photomultiplier tubes described above do not effectively strike the first dynode. Especially, some electrons emitted from the periphery of the photocathode or some secondary electrons emitted from the periphery of the first dynode may pass through without impinging on the first, second, and/or higher order dynodes.

In this case, the effective area of the photocathode is reduced, and effective sensitivity is lowered. In addition, output signals in the photocathode are not uniform, which leads to loss of sharpness at the edges of an image when the device is used for image processing.

In order to solve the above problems, a photomultiplier tube according to the present invention is characterized by comprising: a faceplate made from glass; a side tube made from glass and having a hollow shape extending along a tube axis which is substantially perpendicular to the faceplate, the side tube being joined to one surface of the faceplate; a photocathode formed on an inner region of the one surface of the faceplate in the side tube to emit a photoelectron in response to light incident on the faceplate; an electron multiplying portion for multiplying the photoelectron emitted from the photocathode; and an anode provided inside the side tube in correspondence with the photocathode for receiving an electron emitted from the electron multiplying section. The electron multiplying portion includes: a first dynode provided inside the side tube for multiplying the photoelectron impinging thereon from the photocathode to emit a secondary electron: a second dynode placed at a substantially same position as a position of the first dynode in a tube axial direction inside the side tube, the second dynode multiplying the secondary electrons impinging thereon from the first dynode to emit a secondary electron; and a plurality dynodes including a third and higher order dynodes, the plurality of dynodes being provided on a downstream side of the first and second dynodes in the tube axial direction inside the side tube for multiplying the secondary electrons impinging thereon from the second dynode in turn to emit secondary electrons; a focusing electrode having a flat plate provided between the second and third dynodes, the flat plate having an aperture that enables the third dynode to face the second dynode; a first screen provided on a first dynode side of the aperture, the first screen extending toward the photocathode across a lower end of the first dynode; and a second screen provided on a second dynode side of the aperture, the second screen extending towards the photocathode so that a front end thereof is positioned above a lower end of the second dynode.

In the photomultiplier tube described above, the photocathode emits photoelectrons in response to light incident thereon The electron multiplying portion includes the plurality of dynodes such as the first dynode, the second dynode, and the third and higher order dynodes and the focusing electrode. The first dynode emits secondary electrons when electrons emitted from the photocathode impinge thereon. The second dynode multiplies electrons impinging thereon from the first dynode to emit secondary electrons. The focusing electrode is provided with the flat plate having the aperture that allows electrons from the second dynode to pass through. The focusing electrode further has the first screen provided on the first dynode side of the aperture of the flat plate. The focusing electrode adjusts the potential in the vicinity of the first and second dynodes, thereby enabling the electrons to impinge on each dynode effectively.

The second screen extending toward the photocathode can be provided on a second dynode side of the aperture of the flat plate in order that the frond end of the second screen is positioned above the lower end of the second dynode.

According to another aspect of the present invention, a photomultiplier tube is characterized by comprising: a faceplate made from glass; a side tube made from glass and having a hollow shape extending along a tube axis which is substantially perpendicular to the faceplate, the side tube being joined to one surface of the faceplate; a photocathode formed on an inner region of the one surface of the faceplate in the side tube to emit a photoelectron in response to light incident on the faceplate; an electron multiplying portion for multiplying the photoelectron emitted from the photocathode; and an anode provided inside the side tube in correspondence with the photocathode for receiving an electron emitted from the electron multiplying section. The electron multiplying portion includes: a first dynode provided inside the side tube for multiplying the photoelectron impinging thereon from the photocathode to emit a secondary electron; a second dynode placed at a substantially same position as a position of the first dynode in a tube axial direction inside the side tube, the second dynode multiplying the secondary electrons impinging thereon from the first dynode to emit a secondary electron; a plurality dynodes including a third and higher order dynodes, the plurality of dynodes being provided on a downstream side of the first and second dynodes in the tube axial direction inside the side tube for multiplying the secondary electrons impinging thereon from the second dynode in turn to emit secondary electrons; a focusing electrode having a first screen formed on a lower end side of the first dynode and extending toward the photocathode rather than a lower end of the first dynode; a flat plate having a cut-away portion that enables the third dynode to face the second dynode; and a second screen provided on a second dynode side of the cut-away portion, the second screen extending towards the photocathode across a lower end of the second dynode, the focusing electrode being secured between the second and third dynodes, thereby forming a space extending from the first dynode to the third dynode.

In the photomultiplier tube described above, the focusing electrode, which is composed of the first and second screens and the flat plate, and the apertures formed by fixing the focusing electrode adjust the potential in the electron multiplying portion to ensure that electrons effectively strike each dynode.

According to another aspect of the present invention, a photomultiplier tube of the present invention is characterized by comprising; a faceplate made from glass; a side tube made from glass and having a hollow shape extending along a tube axis which is substantially perpendicular to the faceplate, the side tube being joined to one surface of the faceplate; a photocathode formed on an inner region of the one surface of the faceplate in the side tube to emit a photoelectron in response to light incident on the faceplate; an electron multiplying portion for multiplying the photoelectron emitted from the photocathode: and an anode provided inside the side tube in correspondence with the photocathode for receiving an electron emitted from the electron multiplying section. The electron multiplying portion includes: a first dynode provided inside the side tube for multiplying the photoelectron impinging thereon from the photocathode to emit a secondary electron; a second dynode placed at a substantially same position as a position of the first dynode in a tube axial direction inside the side tube, the second dynode multiplying the secondary electrons impinging thereon from the first dynode to emit a secondary electron; a plurality dynodes including a third and higher order dynodes, the plurality of dynodes being provided on a downstream side of the first and second dynodes in the tube axial direction inside the side tube for multiplying the secondary electrons impinging thereon from the second dynode in turn to emit secondary electrons; and a focusing electrode having: a first screen formed on a lower end side of the first dynode and extending toward the photocathode across a lower end of the first dynode; a flat plate provided between the second and third dynodes, the flat plate having a first cut-away portion that enables the third dynode to face the second dynode and a second cut-away portion formed between the first and third dynodes; and a second screen provided on a second dynode side of the first cut-away portion and extending towards the photocathode across a lower end of the second dynode.

In the photomultiplier tube described above, the focusing electrode, which is composed of the first and second screens and the flat plate to form the first and second apertures, adjusts the potential of the electron multiplying portion to ensure that electrons effectively strike each dynode.

Preferably, the focusing electrode is maintained at the potential that is higher than that of the second dynode and lower than that of the third dynode. According to this construction, the electrons emitted from the second stage dynode are converged by the focusing electrode to effectively impinge on the third dynode.

The photomultiplier tube according to the present invention is characterized by comprising: a faceplate made from glass; a side tube made from glass and having a hollow shape extending along a tube axis which is substantially perpendicular to the faceplate, the side tube being joined to one surface of the faceplate; a photocathode formed on an inner region of the one surface of the faceplate in the side tube to emit a photoelectron in response to light incident on the faceplate; an electron multiplying portion for multiplying the photoelectron emitted from the photocathode; and an anode provided inside the side tube in correspondence with the photocathode for receiving an electron emitted from the electron multiplying section. The electron multiplying portion includes: a first dynode provided inside the side tube for multiplying the photoelectron impinging thereon from the photocathode to emit a secondary electron; a second dynode placed at a substantially same position as a position of the first dynode in a tube axial direction inside the side tube, the second dynode multiplying the secondary electrons impinging thereon from the first dynode to emit a secondary electron; a plurality dynodes including a third and higher order dynodes, the plurality of dynodes being provided on a downstream side of the first and second dynodes in the tube axial direction inside the side tube for multiplying the secondary electrons impinging thereon from the second dynode in turn to emit secondary electrons; and a first focusing electrode provided on a lower side of the first dynode and on an upper side of the third dynode; and a second focusing electrode provided on a lower side of the second dynode and on the upper side of the third dynode. An electron multiplied by the second dynode travels in a space between the fist and second focusing electrodes to impinge on the third dynode.

In the photomultiplier tube described above, the first and second focusing electrodes adjust the potentials in the electron multiplying portion so that electrons traveling from the second dynode pass through a space between the first focusing electrode and the second electrode to impinge on the third dynode. Accordingly, electrons effectively impinge on each dynode.

BEST MODE FOR CARRYING OUT THE INVENTION

Figure 1:
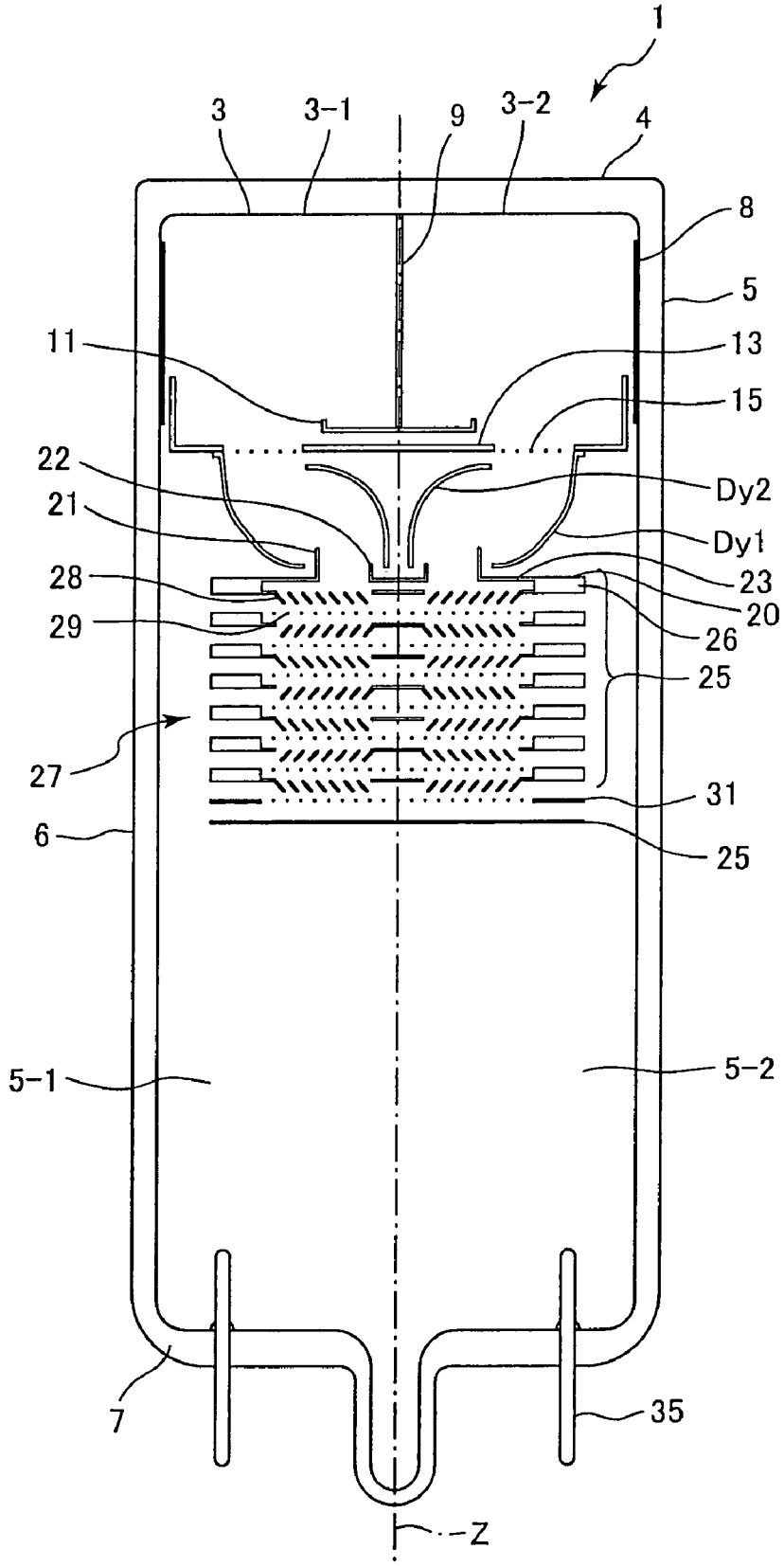
FIG. 1 is a cross-sectional view of a multi-anode type photomultiplier tube 1 according to the first embodiment of the present invention taken along the line A–A' of in FIG. 2.

A multi-anode type photomultiplier tube 1 according to the first embodiment of the present invention will be described while referring to the drawings.

First, the configuration of the multi-anode type photomultiplier tube 1 is described referring to FIGS. 1 to 4. As shown in FIG. 1, the multi-anode type photomultiplier tube 1 is a 2×2 multi-anode type photomultiplier tube. The multi-anode type photomultiplier tube 1 has a substantially quadratic prism glass container 5. The glass container 5 is made from transparent glass. Referring to FIG. 1, the glass container 5 has a faceplate 4 for receiving light incident on an upper surface.

The faceplate 4 has a photocathode 3 formed on an inside surface thereof. A side surface of the glass container 5 extends along a tube axis Z which is substantially perpendicular to the faceplate 4, so that the glass container 5 has a hollow side tube 6. I/O pins 35 are provided at a bottom 7 of the glass container 5. The faceplate 4, the side tube 6, and the bottom 7 are integrated together to hermetically seal the glass container 5.

An aluminum thin film 8 is vapor deposited on an upper inner surface of the side tube 6 of the glass container 5. The aluminum thin film 8 is maintained at the same potential as that of the photocathode 3. An outer surface of the side tube 6 of the glass container 5 is provided with a magnetic shield (not shown) made from a magnetic material such as permalloy and is further covered with a tube made from a resin.

A partitioning wall 9, a shield electrode 11, a flat electrode 13, a mesh 15, a first dynode Dy1, a second dynode Dy2, a screen focusing electrode 20, a dynode array 25 and an anode 31 are provided in the glass container 5. The first dynode Dy1, the second dynode Dy2, the screen focusing electrode 20, and the dynode array 25 function as the electron multiplying portion.

The photocathode 3, the shield electrode 11, the flat electrode 13, the first dynode Dy1, the second dynode Dy2, the dynode array 25, and the anode 31 inside the glass container 5 are electrically connected to the I/O pins 35 by wires (not shown), Each of the above components is maintained at a predetermined potential.

Figure 2:
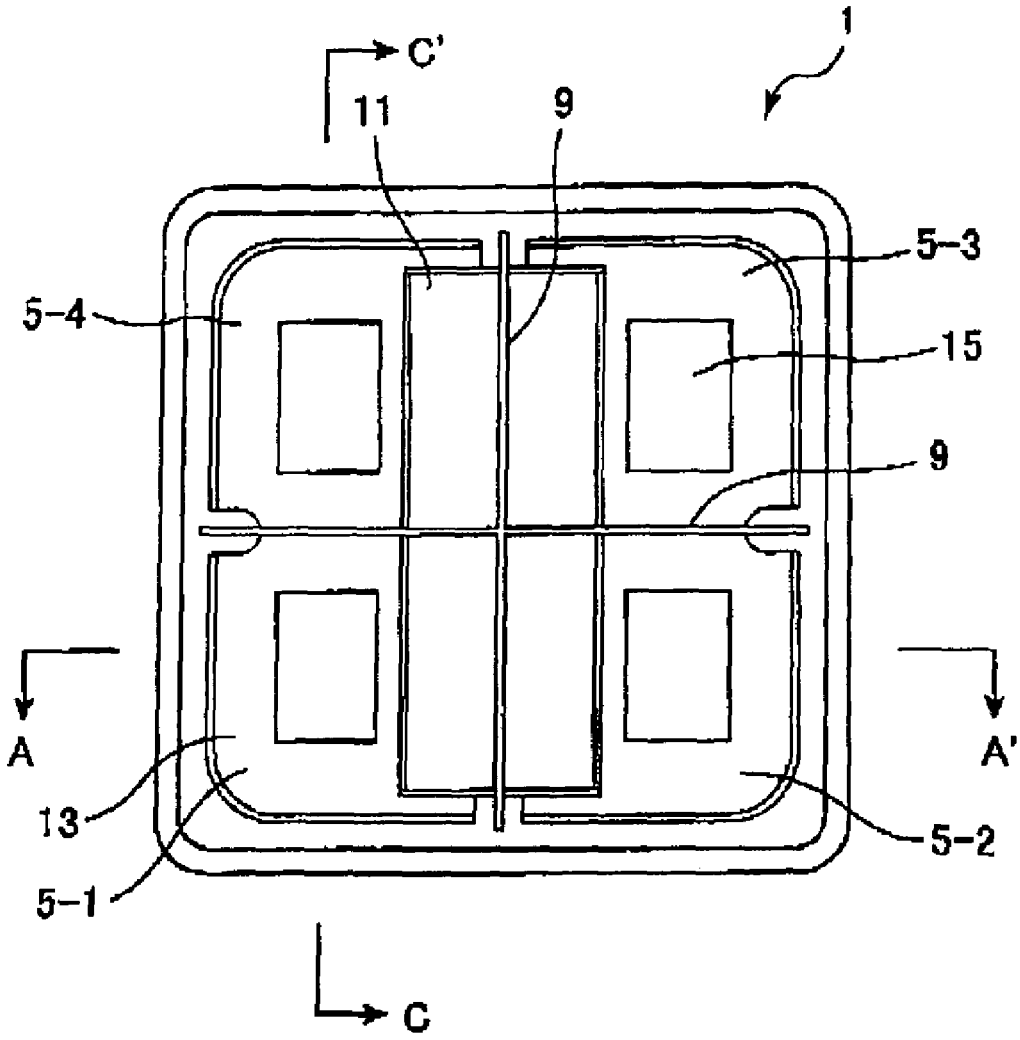
FIG. 2 is a plan view showing the multi-anode type photomultiplier tube 1 from above.
Figure 3:
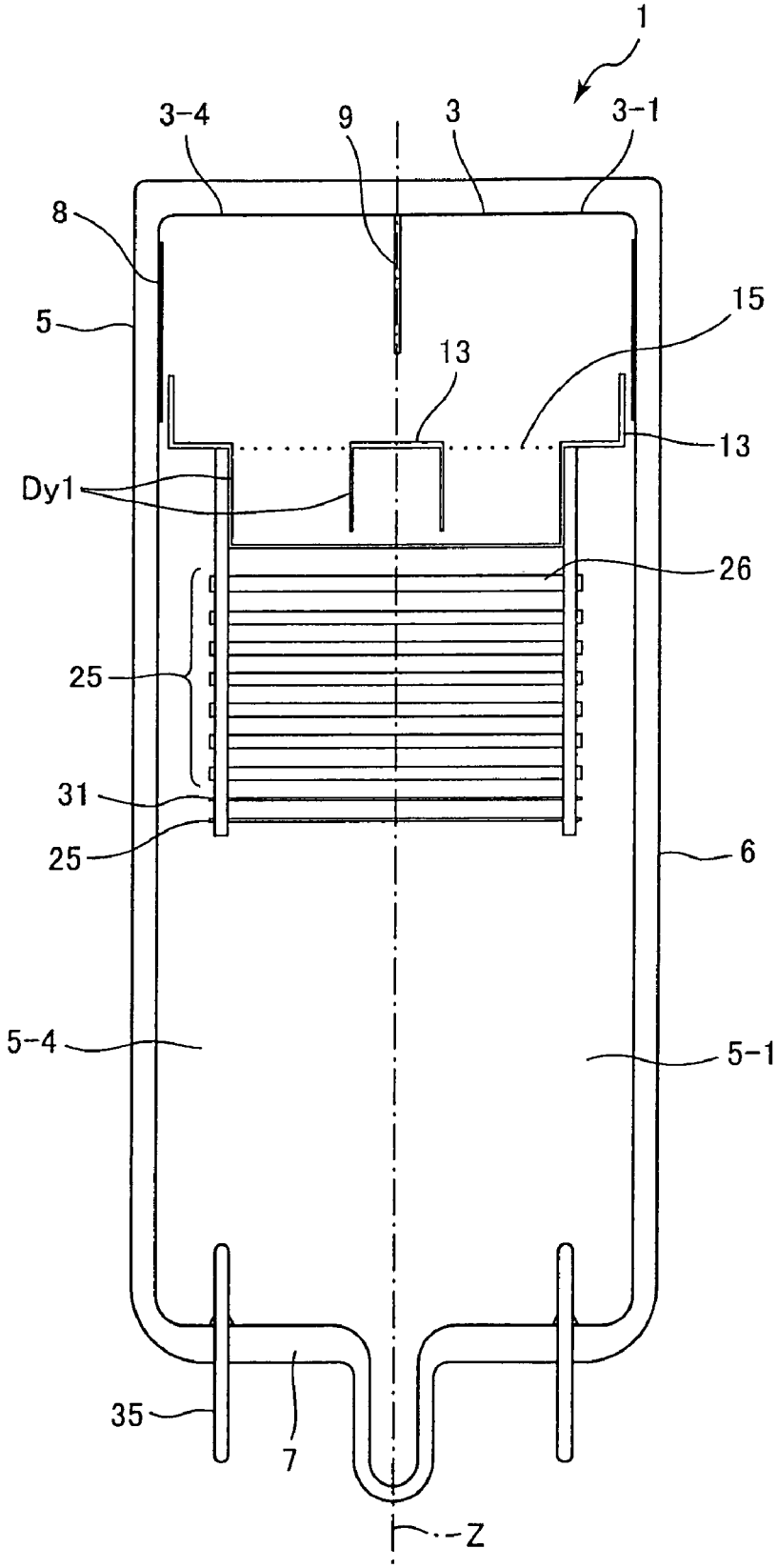
FIG. 3 is a cross-sectional view of the multi-anode type photomultiplier tube 1 taken along the line C–C' in FIG. 2.

The partitioning wall 9 is made from a conductive material and extends from the photocathode 3 along the axis Z. As shown in FIG. 2, the partitioning wall 9 has a cross shape as seen from above and divides an electron focusing space into four space segments 5-1 to 5-4 in the glass container 5. As shown in FIG. 1, the bottom part of the partitioning wall is electrically connected to the shield electrode 11. The partitioning wall 9 is maintained at the same potential as that of the photocathode 3.

The shield electrode 11 is made from a flat conductive material and is disposed below the partitioning wall 9 in the glass container 5 to prevent the second dynode Dy2 from facing the photocathode 3. In the embodiment shown in this figure, the shield electrode 11 has a rising portion from a peripheral edge that extends toward the photocathode 3 in order to reinforce the shield electrode 11. The shield electrode 11 is maintained at the same potential as that of the photocathode 3.

As shown in FIG. 2, the flat electrode 13 is provided with apertures and disposed beneath the shield electrode 11 to cover a cross section of the glass container 5. The flat electrode 13 has a rising portion on the peripheral edge that extends towards the photocathode 3. In the embodiment shown in the figure, four apertures are arranged around the center axis Z in a (2×2) array manner in the flat electrode 13. Electrons emitted from photocathode segments 3-1, 3-2 and 3-4 corresponding to the space segments 5-1, 5-2 and 5-4, respectively, are allowed to travel through the respective aperture. Although not shown in any of the figures, a fourth photocathode segment corresponds to space segment 5-3 in the same manner.

The flat electrode 13 is maintained either at the same potential as that of the first dynode Dy1 or at a slightly higher potential than that of the first dynode Dy1 which does not exceed the potential of the second dynode Dy2.

The mesh 15 is placed in each of the apertures of the flat electrode 13 The mesh 15 is made from an electrically conductive mesh member. The mesh 15 is maintained at the same potential as that of the first dynode Dy1 or at slightly higher potential than that of the first dynode Dy1 which does not exceed the potential of the second dynode Dy2.

The first dynode Dy1 is disposed beneath each of the mesh 15. In other words, one first Dy1 dynode is displaced for each space segment 5-1 to 5-4, so that a total of four first Dy1 dynodes are placed in the glass container 5.

The first dynode Dy1 consists of a horizontal portion that extends straight in a horizontal direction, a vertical portion that extends straight in an axial direction, and a diagonal portion that extends diagonally to connect the horizontal and vertical portions. Each of the first dynode Dy1 is disposed near the side tube 6 in the glass container 5 in order to face the corresponding photocathode 3-1 to 3-4 through the space segments 5-1 to 5-4. Note that the first dynode Dy1 is maintained at the potential that is higher than that of the photocathode 3 and lower than that of the anode 31.

The second dynode Dy2 consists of a horizontal portion that extends straight in the horizontal direction, a vertical portion that extends straight along the axial direction, and a diagonal portion that connects the horizontal and vertical portions and extends diagonally. The second dynode Dy2 is disposed near the axis Z in the glass container 5 to face the corresponding first dynode Dy1. Thus, one second dynode Dy2 is provided in each space segment 5-1 to 5-4 in the glass container 5, and a total of four second stage dynodes Dy2 is disposed.

Among the four second dynodes Dy2, the vertical portions of the two second dynodes in the space segments 5-1 and 5-2 are integrated together through their backs. Similarly, the vertical portions of the two second dynodes Dy2 in the space segment 5-3 and 5-4 are joined together through their backs. The second dynode Dy2 is maintained at the potential that is higher than that of the first dynode Dy1 and lower than that of the anode 31.

Figure 4:
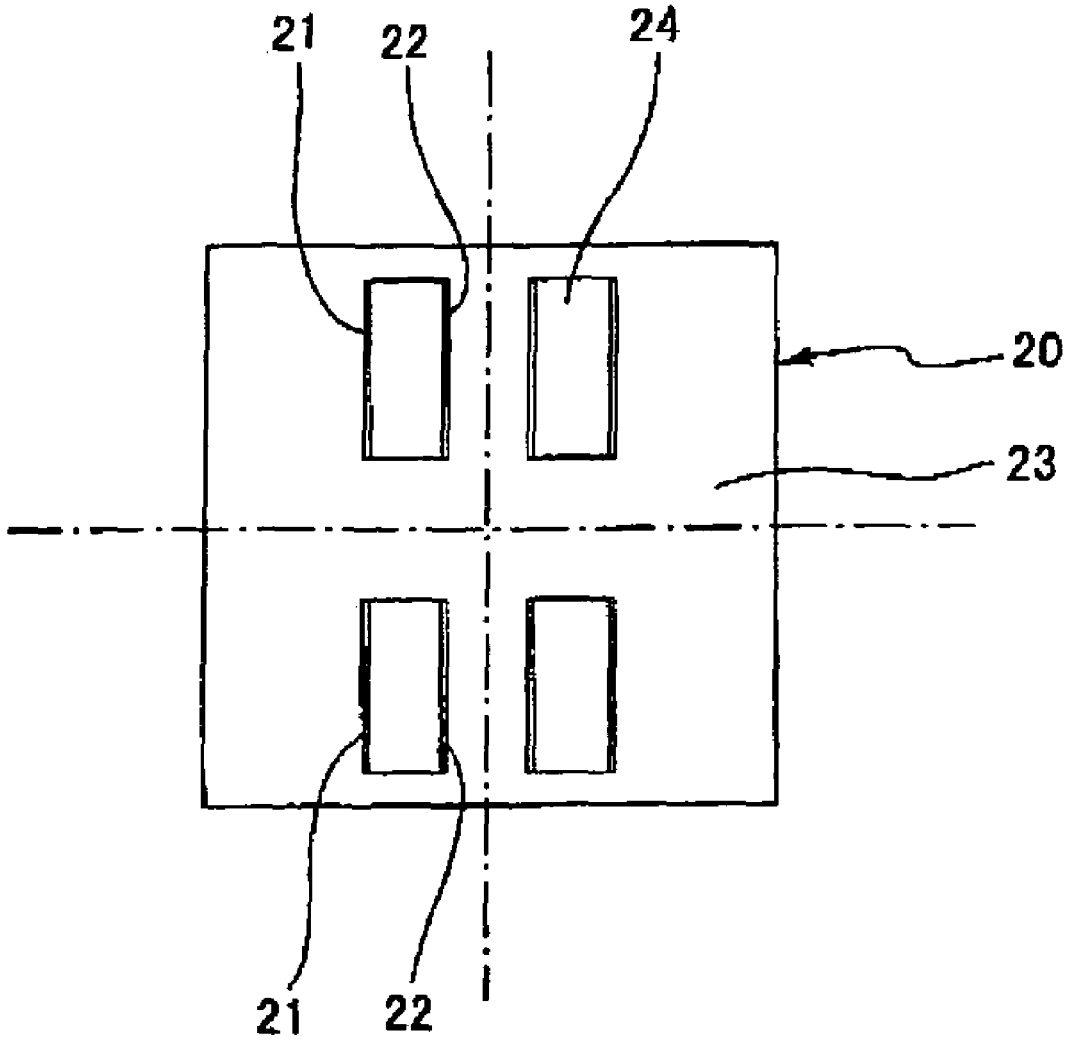
FIG. 4 is a top view of a screen focusing electrode 20 of the multi-anode type photomultiplier tube 1.

A screen focusing electrode 20 is disposed between the dynode array 25 and the first and second dynodes Dy1, Dy2. The screen focusing electrode 20 is maintained at the potential which is higher than that of the second dynode Dy2 and lower than that of the third dynode Dy3, preferably, equal to that of the third dynode Dy3. As shown in FIG. 4, the screen focusing electrode 20 consists of first screens 21, second screens 22, a flat plate 23, and apertures 24.

The four apertures 24 are arranged around the axis Z in a 2×2 matrix manner so that each aperture faces the corresponding second dynode Dy2. The first screen 21 extending towards the photocathode 3 is formed at the periphery of the aperture 24 in the vicinity of the first dynode Dy1. The first screen 21 is placed in each segment 5-1 to 5-4 in the glass container 5, so that a total of four first screens 21 are placed. The first screen 21 preferably extends across the lower end of the first dynode Dy1 towards the photocathode 3.

The second screen 22 extending towards the photocathode 3 is formed at the periphery of aperture 24 in the vicinity of the second dynode Dy2. The second screen 22 is formed in each segment 5-1 to 5-4 in the glass container 5, so that a total of four second screens 22 is formed. The second screen 22 extends across the lower end of the second dynode Dy2.

The dynode array 25 in the multi anode type photomultiplier tube is a Venetian blind type. The dynode array consists of flat plate portions 26 and four dynode portions 27. The four dynode portions 27 correspond to the four apertures 24 and extend from the first screen 21 of the aperture 24 toward the side tube 6.

Each dynode portion 27 in the dynode array 25 is provided with a plurality of electrode elements 28. The electrode elements 28 in the third, fifth, seventh, and ninth dynodes Dy3, Dy5, Dy7 and Dy9 is inclined 45° with respect to the tube axis Z so that the secondary electron emission surface of the electrode element faces the second dynode Dy2. The electrode elements 28 in the fourth, sixth, and eighth dynodes Dy4, Dy6, and Dy8 are inclined 45° with respect to the axis Z in the opposite direction to those of the third, fifth, seventh and ninth dynodes Dy3, Dy5, Dy7 and Dy9.

The flat plate portions 26 of the third dynode Dy3 are integrated together so that the flat plate 23 of the screen focusing electrode 20 is placed above the dynode portions 27. The mesh electrode 29 is provided on top of the electrode elements 28 and integrated with the flat plate 26 of the fourth to the ninth dynodes Dy4 to Dy9.

One anode 31 is provided below each of the four ninth dynodes Dy9. A tenth dynode Dy10 is provided above the anode 31. The tenth dynode Dy 10 emits secondary electrons towards the anode 31, when electrons emitted by the ninth dynode Dy9 impinge on the tenth dynode Dy10. When the electrons impinge on the anode 31 from the tenth dynode Dy10, the anode 31 detects the electrons.

The multi-anode type photomultiplier tube 1 having the configuration described above operates as follows.

A predetermined voltage is applied to the photocathode 3, the partitioning wall 9, the shield electrode 11, the flat electrode 13, the screen focusing electrode 20, the first dynode Dy1, the second dynode Dy2, the dynode array 25, and the anodes 31 via the I/O pins 35.

When light strikes any one of the space segments 5-1 to 5-4 on the faceplate 4, the corresponding one of the photocathode 3-1 to 3-4 emits the number of photoelectrons that corresponds to the amount of incident light. The emitted photoelectrons are converged by the partitioning wall 9, the shield electrode 11, and the flat electrode 13 in the corresponding space segment to pass through the corresponding mesh 15 and impinge on the first dynode Dy1.

The first dynode Dy1 emits secondary electrons in response to the photoelectrons impinging thereon. These secondary electrons are converged by the screen focusing electrode 20 to impinge on the second dynode Dy2.

Since the first screen 21 extends upwards across the lower end of the first dynode Dy1, the equipotential lines made by the first dynode Dy1 are raised upwards. These equipotential lines are brought closer to the horizontal portion rather than the diagonal portion of the second dynode Dy2. Therefore, a major part of the vertical and diagonal portions of the second dynode Dy2 is available for emitting secondary electrons.

The electrons emitted by the second dynode Dy2 travel to the third dynode Dy3 that is maintained at the higher potential than that of the second dynode Dy2. Since the second screen 22 protrudes upwards across the lower end of the second dynode Dy2, the electrons emitted from the second dynode Dy2 are efficiently guided to the aperture 24 in the screen focusing electrode 20.

The electrons that have passed through the aperture 24 impinge on the third dynode Dy3. The third dynode Dy3 extends beyond the aperture 24 towards the side tube 6 to efficiently capture the electrons passing through the aperture 24. The electrons are successively multiplied in the dynode array 25 to impinge on the anode 31.

The anode 31 generates a signal that corresponds to the number of impinging electrons and then outputs the signal to the outside of the glass container 5 via the I/O pins 35.

The shield electrode 11, the flat electrode 13, the screen focusing electrode 20, the first dynode Dy1, the second dynode Dy2, the dynode array 25, and the anode 31 are disposed in the glass container 5 of the multi-anode type photomultiplier tube 1. A magnetic shield is provided on the outer periphery of the glass container 5 to ensure that the converging and multiplying of photoelectrons can be accurately performed without any interference from external magnetic fields.

Next, the operations of the screen focusing electrode 20 will be described while referring to FIGS. 5 to 8.

Figure 5:
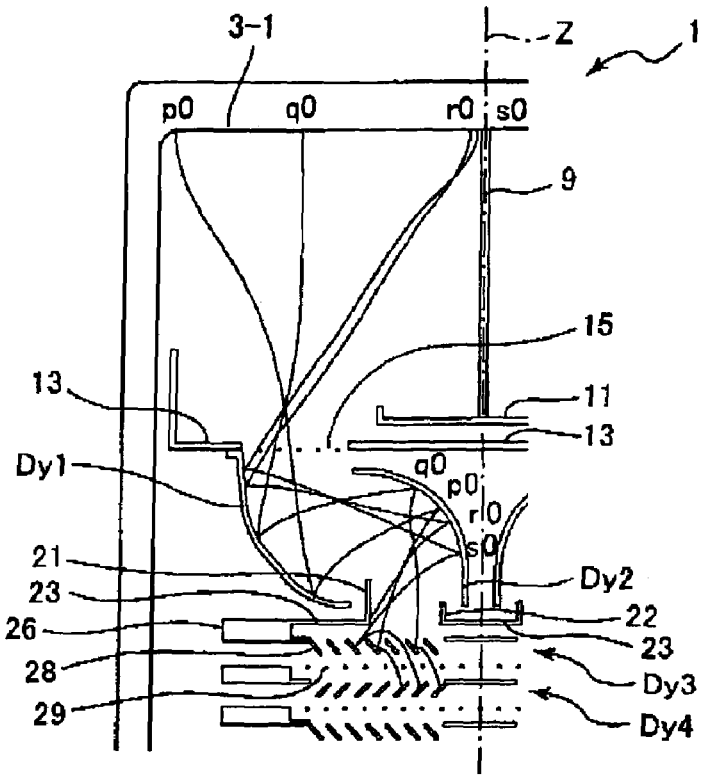
FIG. 5 shows electron trajectories in the multi-anode type photomultiplier tube 1.

FIG. 5 is a view showing electron trajectories in the multi-anode type photomultiplier tube 1. In the multi-anode type photomultiplier tube 1, the first screen 21 and the second screen 22, as well as the flat plate 23, are maintained at the potential that is higher than that of the second stage dynode Dy2 and lower that of the third dynode Dy3, or preferably identical to that of the third dynode Dy3. This potential difference controls the electron trajectories from the first dynode Dy1 to the second dynode Dy2 and the ones from the second dynode Dy2 to the third dynode Dy3. As a result, each electron trajectory p0, q0, r0 or s0 is drawn as shown in the figure to impinge on the first dynode Dy1 and second dynode Dy2 without deviating therefrom.

However, the trajectories of the electrons emitted from the second dynode Dy2 after impinging thereon reveals that the electron with the trajectory r0 collides with the first screen 21 after being emitted from the second dynode Dy2. In other words, the light that has generated the electron with the trajectory r0 can not be detected by the anode 31. The electrons with the trajectories p0, q0, and s0 impinge on the third dynode Dy3 and then on the fourth dynode Dy4.

Thus although the detection of the incident light in the periphery of the multi-anode type photomultiplier tube 1 is impaired, overall detection of incident light is satisfactory.

Figure 6:
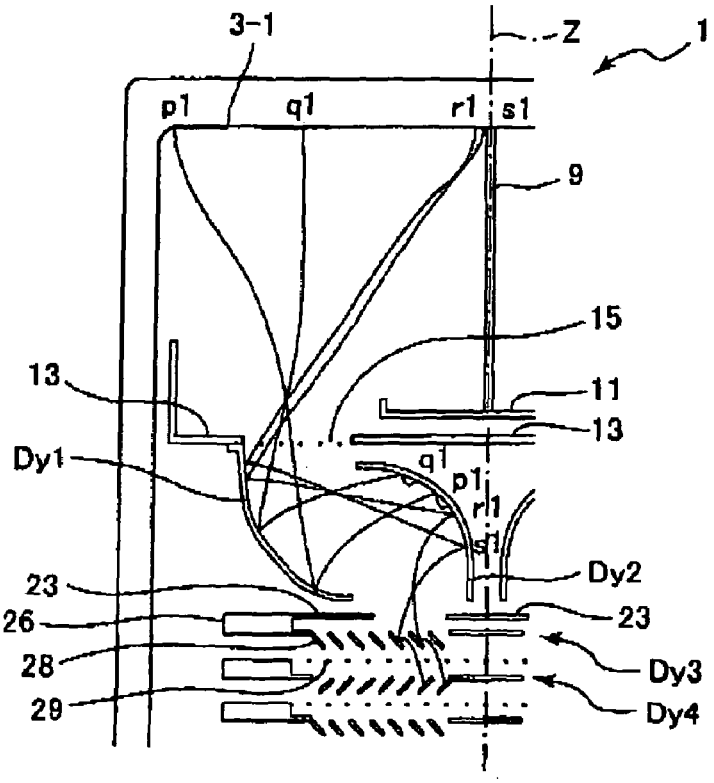
FIG. 6 shows electron trajectories in the multi-anode type photomultiplier tube 1 without a first screen 21 and a second screen 22.

By way of a comparison, FIG. 6 shows electron trajectories in a photomultiplier tube without the first screen 21 and the second screen. In FIG. 6, electron trajectories p1, q1, r1, and s1 are the trajectories of the electrons emitted by incident light on the substantially the same positions on the photocathode 3-1 as the light that has generated the electrons with the trajectories p0, q0, r0, and s0.

As shown in FIG. 6, when the first screen 21 and the second screen 22 are not provided in the photomultiplier tube, the electron trajectories p1, q1, r1, and s1 strike the second dynode Dy2 at locations that are closer to the photocathode than those of the electron trajectories p0, q0, r0, and s0. In addition, since the magnetic field generated by the third dynode Dy3 is weak, the influence of the negative potential of the first dynode Dy1 to the second dynode Dy2 is stronger. This influence prevents a large number of secondary electrons such as the electrons with the trajectories p1 and q1 from launching from the second dynode Dy2. Thus the light striking the photocathode 3 can not efficiently detected.

Figure 7:
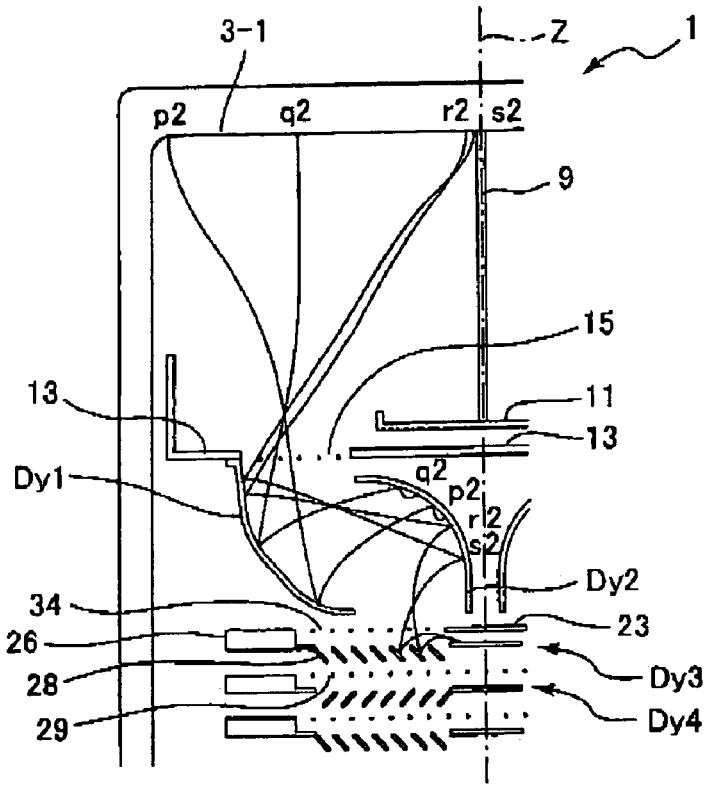
FIG. 7 shows electron trajectories in the multi-anode type photomultiplier tube 1 having a mesh 24 without the first screen 21 and the second screen 22.

FIG. 7 shows electron trajectories when the photomultiplier tube has a mesh 34 provided over the aperture 24 in the flat plate 23 and the area between the first dynode Dy1 and the third dynode Dy3 without the first screen 21 and the second screen 22. In FIG. 7, the electron trajectories p2, q2, r2, and s2 are generated by light striking on the substantially same points of the photocathode 3-1 as those of the electron trajectories p0, q0, r0, and s0.

As shown in FIG. 7, since the photomultiplier tube does not have the first screen 21 and the second screen 22, the electron trajectories p2, q2, r2, and s2 strike on the second dynode Dy2 at the locations that are closer to the photocathode than those of the electron trajectories p0, q0, r0 and s0 which are similar to the electron trajectories p1, q1, r1, and s1. In addition, since the magnetic field generated by the third dynode Dy3 is weak, the influence by the negative potential of the first dynode Dy1 on the second dynode Dy2 is strong, which prevents a large number of secondary electrons from launching from the second dynode Dy2, such as the electron trajectories p2 and q2 in the figure.

Because the mesh 34 is provided in the third dynode Dy3, the secondary electrons emitted from the third dynode Dy3 are not affected by the negative potential of the first dynode Dy1, so that some electrons such as the electrons with the trajectories r2 and s2 in the figure do not impinge on the fourth dynode Dy4. Therefore, it becomes almost impossible to detect light that strikes the photocathode 3.

Figure 8:
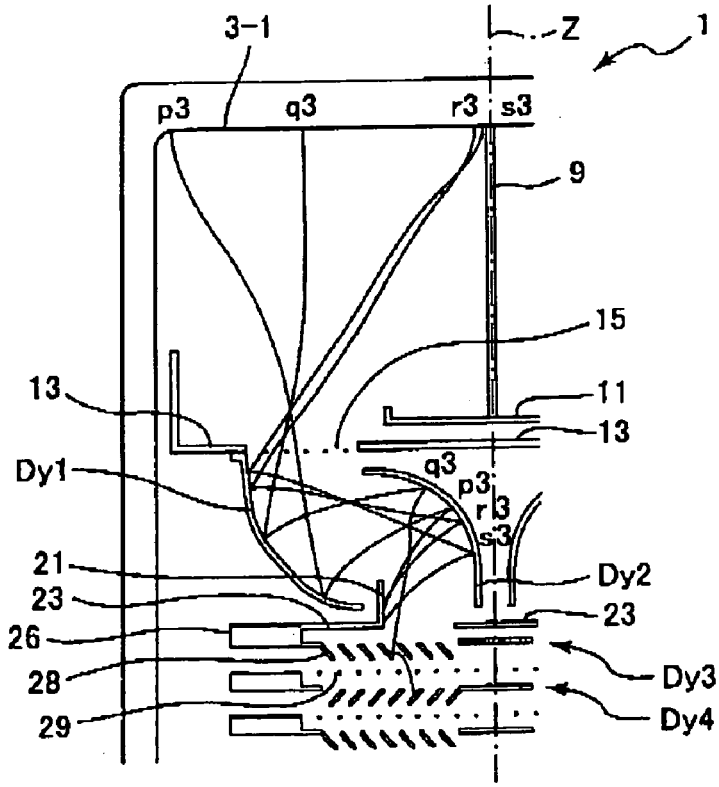
FIG. 8 shows electron trajectories in the multi-anode type photomultiplier tube 1 without the second screen. 22.

FIG. 8 shows electron trajectories in the photomultiplier tube without the second screen 22 as a third comparison. In FIG. 8, the electron trajectories p3, q3, r3, and s3 are generated by light impinging on the photocathode 3-1 in the substantially same locations as those of the light producing the electron trajectories p0, q0, r0, and s0.

As shown in FIG. 8, when the photomultiplier tube has no second screen 22, the electron trajectories p3, q3, r3, and s3 impinge on the substantially same locations of the second dynode Dy2 as those of the electron trajectories p0, q0, r0, and s0. However, the secondary electrons emitted from the second dynode Dy2 are attracted by the first screen 21 and the flat plate 23 below the first dynode Dy1 to collide with the first screen 21 such as the electron trajectories q3, r3, and s3. Therefore, the amount of electrons that reach the third dynode Dy3 is reduced, thereby lowering the efficiency of detecting the light that strikes photocathode 3.

As described above, the multi-anode type photomultiplier tube 1 according to the first embodiment is provided with the electron multiplying section having the first dynode Dy1, the second dynode Dy2, and the dynode array 25, and the anode 31 in a glass container 5, thereby multiplying the light striking the photocathode 3 to detect the multiplied light by the anodes 31.

The multi-anode type photomultiplier tube 1 also has the screen focusing electrode 20 provided with: the flat plate 23 provided between the second dynode Dy2 and the third dynode Dy3, the flat plate having the aperture 24 that allows the third dynode Dy3 to face the second dynode Dy2; the first screen 21 on the first dynode Dy1 side of the apertures 24, the screen extending across the lower end of the first dynode Dy1 towards the photocathode 3; and the second screen 22 provided on the second dynode Dy2 side of the apertures 24, the screen extending across the lower end of the second dynode Dy2 towards the photocathode 3. The screen focusing electrode 20 is maintained at the potential that is higher than that of the second dynode Dy2 and lower than that of the third dynode Dy3.

According to the above structure, the electrons emitted in response to light incident on the photocathode 3 are guided to impinge on the multiplying portion including the first dynode Dy1, the second dynode Dy2, and the third dynode Dy3 regardless of where the light impinges on the photocathode 3. Thus, the light incident on the photocathode can be detected regardless of where the light strikes the photocathode. Accordingly, it is possible to obtain a clear image when the photomultiplier is used in an image display device.

Next, a multi-anode electron multiplier tube 100 of the second embodiment according to the present invention will be described while referring to FIGS. 9 to 13. The similar parts and components in this embodiment to those of the first embodiment will be designated with the same reference numerals.

As shown in FIGS. 9 to 12, the following components in the photomultiplier 100 are substituted for the corresponding components in the multi-anode type photomultiplier tube 1: a partitioning wall 109 is substituted for the partitioning wall 9, a screen focusing electrode 120 is substituted for the screen focusing electrode 20, and a shield electrode 110 is substituted for the shield electrode 11.

Figure 10:
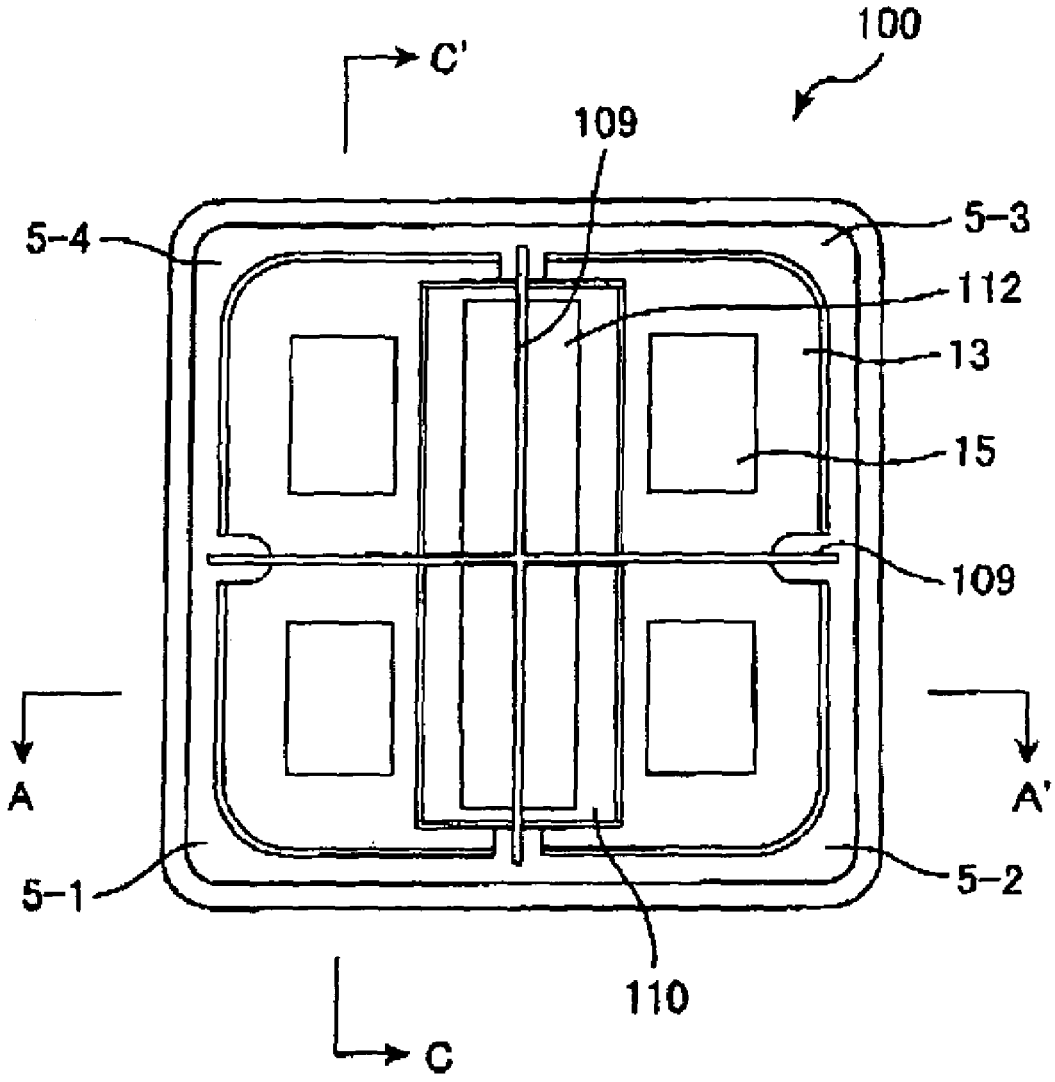
FIG. 10 is a plan view showing the multi-anode type photomultiplier tube 100 from above.
Figure 11:
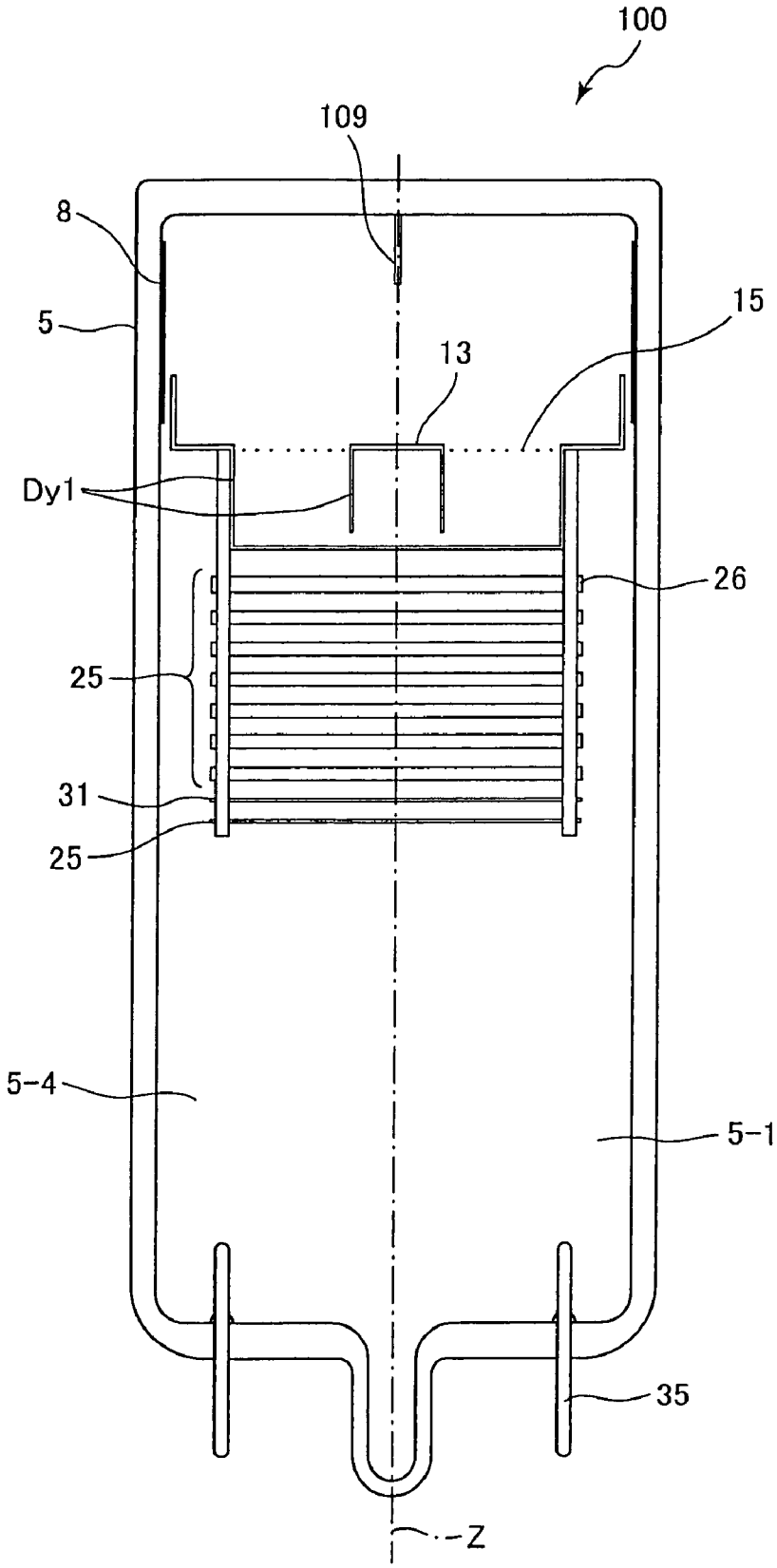
FIG. 11 is a cross-sectional view showing the multi-anode type photomultiplier tube 100 taken along the line C–C' in FIG. 2.

The partitioning wall 109 is made from an electrically conductive material and extends along the axis Z from the photocathode 3. As shown in FIG. 10, the partitioning wall 109 has a cross-shaped, as seen from above. The partitioning wall divides an electron converging space in the glass container 5 into four space segments 5-1 to 5-4 as the partitioning wall 9. An opening space 108 is provided between the lower end of the partitioning wall 109 and the shield electrode 110. The partitioning wall 109 is maintained at the same potential as that of the photocathode 3.

As shown in FIG. 10, the shield electrode 110 is made from an electrically conductive plate and disposed below the partitioning wall 109 and above the flat electrode 13 inside the glass container 5. As seen in the figure, a rise is provided at the periphery of the shield electrode 110 to rise towards the photocathode 3 and serves to reinforce the shield electrode 110. The shield electrode 110 is provided with an aperture 112 at the center. The aperture 112 has a rectangular shape from above. The shield electrode 110 is maintained at the same potential as that of the photocathode 3.

Figure 9:
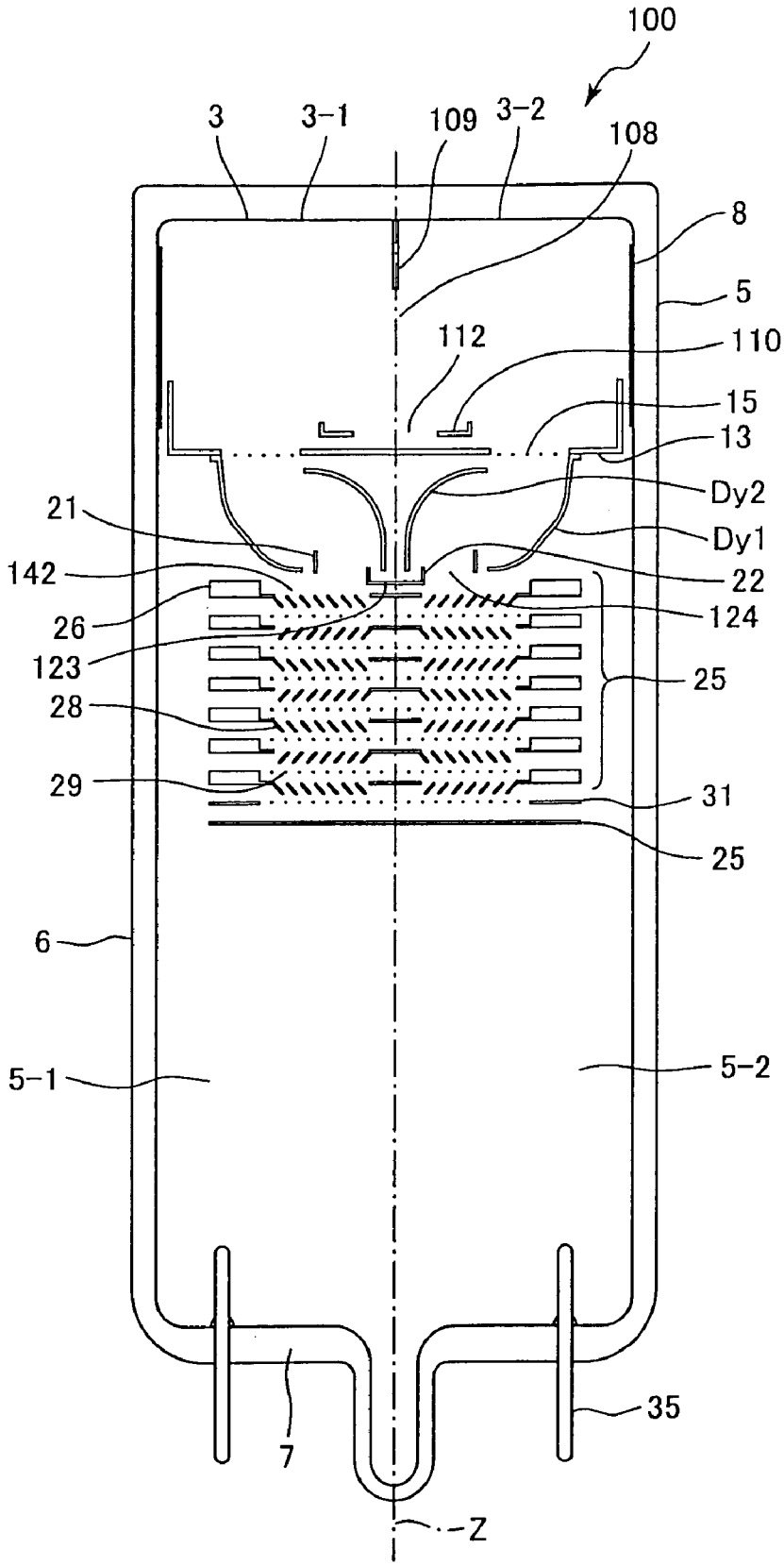
FIG. 9 is a cross-sectional view showing a multi-anode type photomultiplier tube 100 according to the second embodiment of the present invention taken along the A–A' line in FIG. 10.
Figure 12:
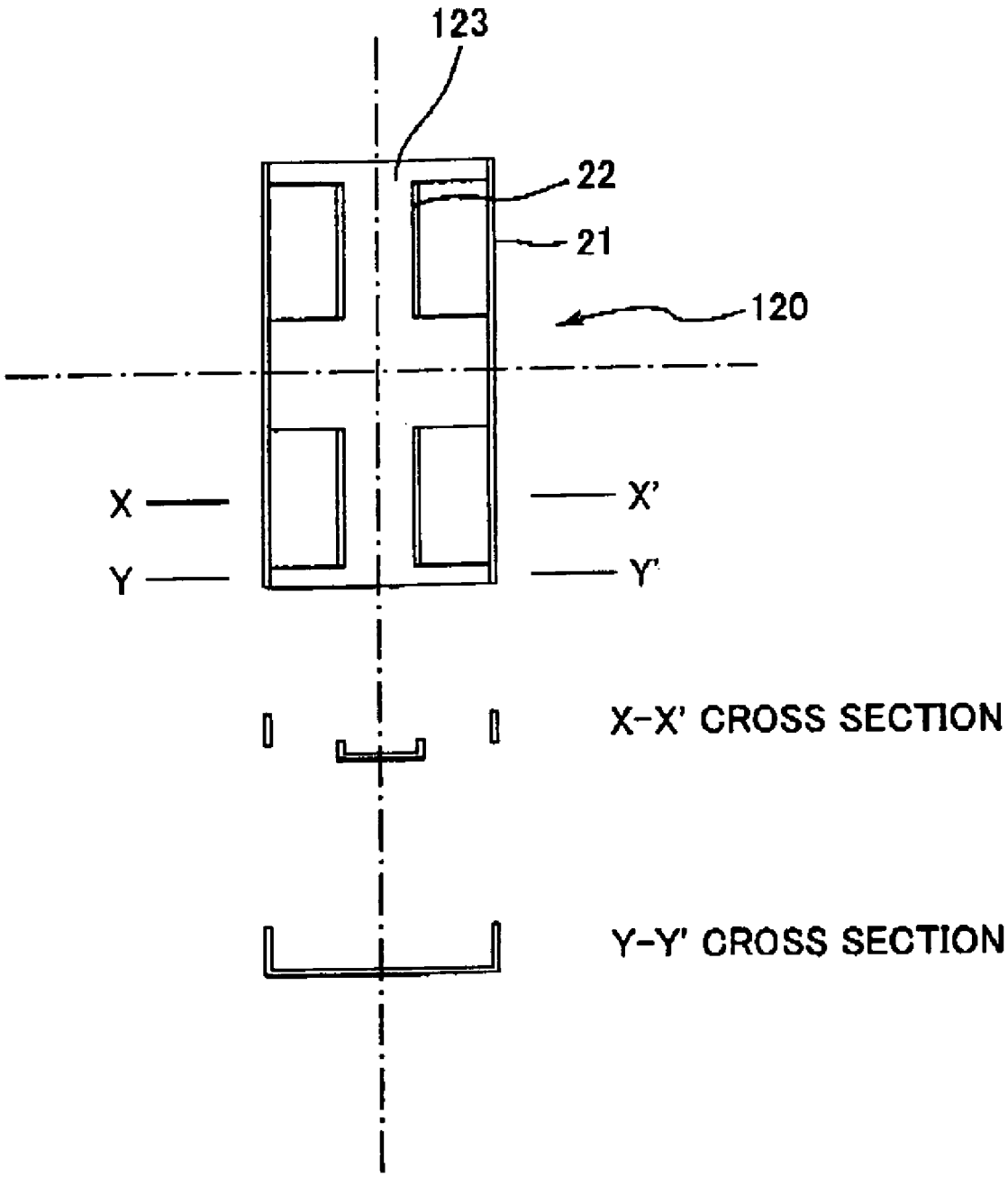
FIG. 12 is a top view showing the screen focusing electrode 120 of the multi-anode type photomultiplier tube 100.

As shown in FIG. 12, the screen focusing electrode 120 has a first screen 21, a second screen 22, and a flat plate 123. The screen focusing electrode 120 is fixed between the second dynode Dy2 and the third dynode Dy3, so that an aperture 142 is defined between the first dynode Dy1 and the third dynode Dy3, as shown in FIG. 9. In other words, the rear surface of the first dynode Dy1 faces the electron impinging surface of the third dynode Dy3.

The first screen 21 and the second screen 22 have the substantially same configuration as the corresponding components in the multi-anode type photomultiplier tube 1. The screen focusing electrode 120 is maintained at the potential which is higher than that of the second dynode Dy2 and lower that of the third dynode Dy3, preferably identical to that of the third dynode Dy3, such as the screen focusing electrode 20.

Other components have the same structure and function as the corresponding components in the multi-anode type photomultiplier tube 1.

Next, the effects of the screen focusing electrode 120 in the multi-anode type photomultiplier tube 100 will be described while referring to FIGS. 5 and 13.

FIG. 5 shows electron trajectories in the multi-anode type photomultiplier tube 1. As described in the first embodiment of the present invention, the electron with the trajectory r0 is not detected by the anode 31, because the electron collides with the first screen 21 and does not impinge upon the third dynode Dy3. Even if this electron impinged on the third dynode Dy3, secondary electrons emitted from the third dynode Dy3 in response to this electron impinging thereon may return on the third dynode Dy3, since the electrons are not influenced by the negative potential of the first dynode Dy1. Additionally, since this electron is not influenced by the negative potential of the first dynode Dy1, the electron may directly impinge on the fourth dynode Dy4 without impinging on the third dynode Dy3 (see the trajectory s0 traveling from the third dynode Dy3 to the fourth dynode Dy4), which results in increase of time required for the secondary electron to travel between the dynodes, degrading the time characteristics of the photomultiplier tube.

Figure 13:
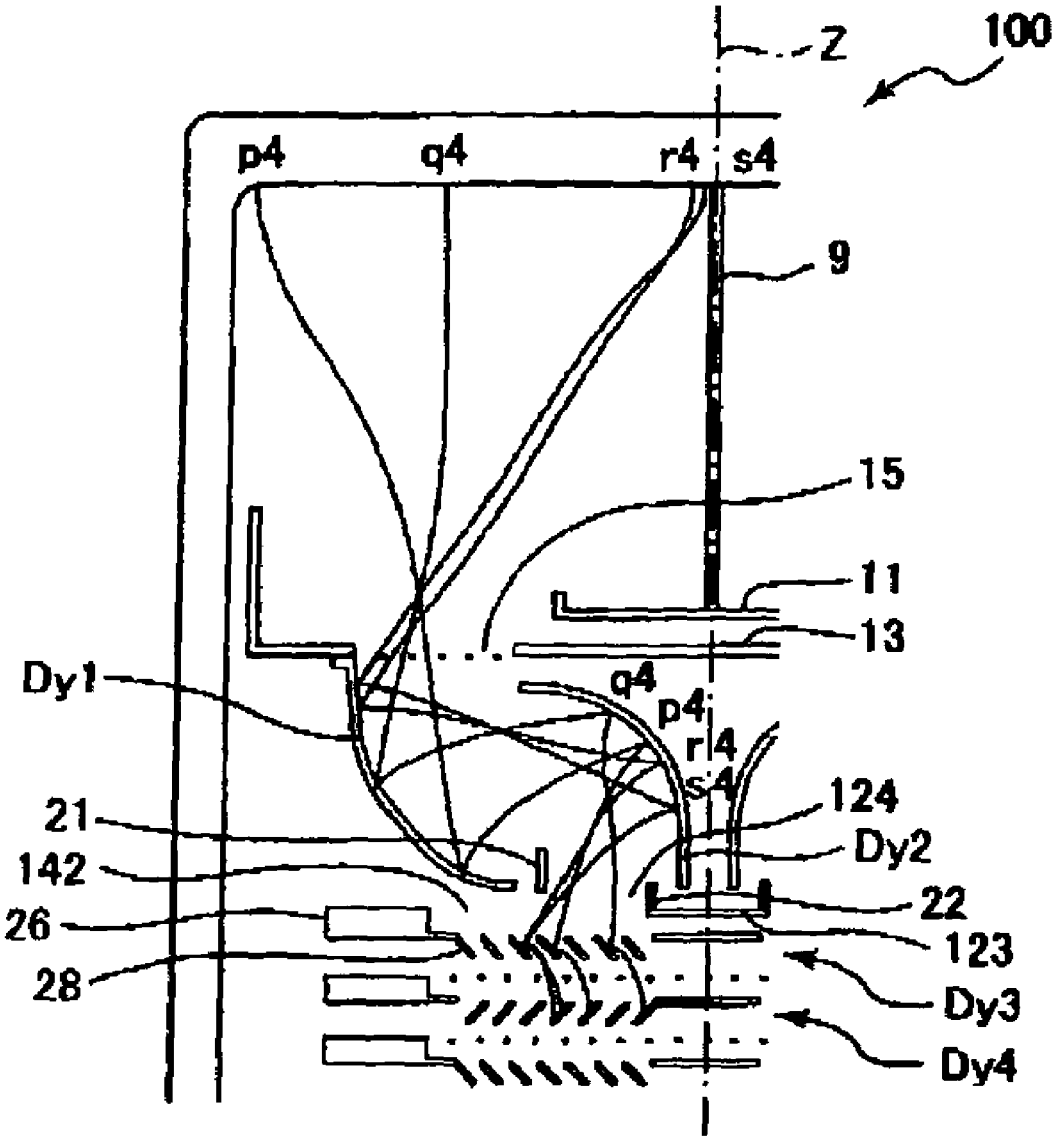
FIG. 13 shows electron trajectories in the multi-anode type photomultiplier tube 100.

In FIG. 13, the electron trajectories p4, q4, r4, and s4 are generated by light that struck the photocathode 3-1 in substantially the same positions as those of the light that generated the electron trajectories p0, q0, r0, and s0. In this embodiment, in order to exhibit the effects of the screen focusing electrode 120, the partitioning wall 9 is substituted for the partitioning wall 109.

The multi-anode type photomultiplier tube 100 has the aperture 142 that is wider than the aperture 24 in the multi-anode type photomultiplier tube 1, thereby providing a wide space between the first dynode Dy1 and the third dynode Dy3. Accordingly, the electron trajectories p4, q4, r4, and s4 all impinge on the third dynode Dy3 and then impinge on the fourth dynode Dy4 which is provided below the third dynode Dy3. This structure speeds up travel of secondary electrons between the second dynode Dy2 and the fourth dynode Dy4, improving time characteristics of the multi-anode type photomultiplier tube 100.

As described above, the multi-anode type photomultiplier tube 100 of the second embodiment provides the electron multiplying section having the first dynode Dy1, the second dynode Dy2, and the dynode array 25; and the anode 31, thereby multiplying electrons in response to light incident on the photocathode 3 and detecting the multiplied electrons by the anode 31.

The opening space 108 is provided between the partitioning wall 109 and: the shield electrode 110. The aperture 112 is provided in the shield electrode 110. The screen focusing electrode 120 is provided with: the flat plate 123 that is disposed between the second dynode Dy2 and the third dynode Dy3, the flat plate having the aperture 142 that extends between the first dynode Dy1 and the third dynode Dy3 and allows the third dynode Dy3 to face the second dynode Dy2; the first screen 21 that extends from the position below the lower end of the first dynode Dy1 and across the lower end thereof towards the photocathode 3; the second screen 22 disposed on the second stage dynode Dy2 side of the aperture 142, the second screen extending towards the photocathode 3 in order that the front end of the screen is located above the lower end of the second dynode Dy2. The screen focusing electrode 120 is maintained at the potential that is higher than that of the second dynode Dy2 and lower than that of the third dynode Dy3.

In this configuration, electrons emitted in response to incident light on the photocathode 3 are efficiently guided to the multiplying portion including the first dynode Dy1, the second dynode Dy2, and the third dynode Dy3 regardless of where on the photocathode the electrons were emitted. The opening space 108 below the partitioning wall 109 and the aperture 112 in the flat electrode 110 make the magnetic field in segments 5-1 to 5-4 more uniform. Therefore, the time difference between the electrons reaching the first dynode Dy1 from photocathode 3 is reduced regardless of where the electrons were generated on the photocathode 3. This results in a sharp image when the photomultiplier is used in an image display device.

Furthermore, since the aperture 142 extends between the first dynode Dy1 and the third dynode Dy3, the secondary electrons emitted from the second dynode Dy2 are prevented from skipping the third dynode Dy3 and then impinging on the fourth dynode Dy4, which further improves the time characteristics on the light detection.

As described above, the light incident on the photocathode 3 is detected with the substantially uniform sensitivity regardless of where the light strikes the photocathode 3. The time characteristics are improved. Accordingly, a sharp image can be obtained when the photomultiplier tube is used in an image display device.

As described above, photomultiplier tubes according to the preferred embodiments of the present invention are described while referring to the drawings. However, the present invention is not limited to the embodiments described above. Some modifications and improvements can be made by those skilled in the art within the scope of the claims.

Figure 14:
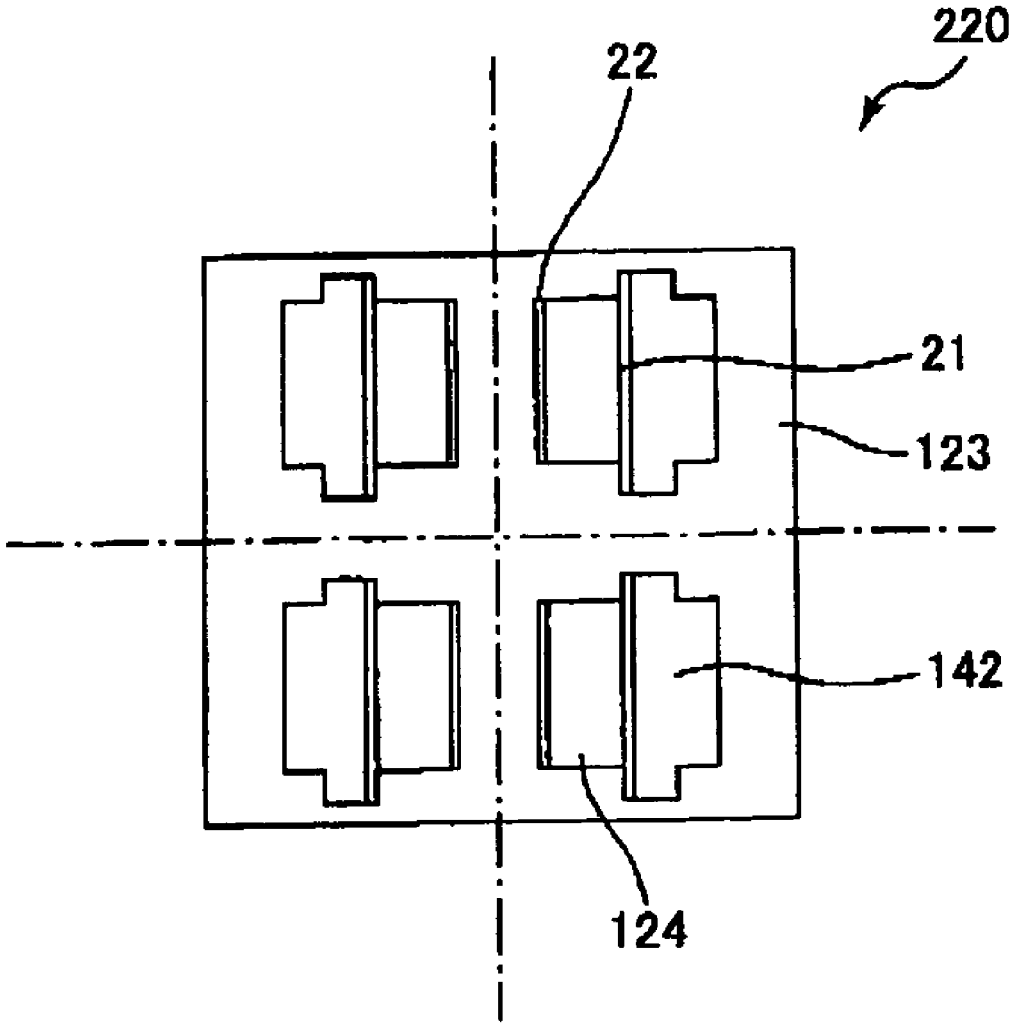
FIG. 14 is a top view showing a screen focusing electrode 220 of the multi-anode type photomultiplier tube 100.

For example, instead of the screen focusing electrode 120 in FIG. 12, a screen focusing electrode 220 shown in FIG. 14 can be used. This screen focusing electrode 220 has one flat plate provided with a first screen 21, a second screen 22, an aperture 142, and an aperture 124. The flat plate can be fixed between the second dynode Dy2 and the third dynode Dy3.

Instead of the focusing electrodes 20 and 120, a first focusing electrode for converging the secondary electrons to the third dynode Dy3 can be provided on the lower side of the first dynode Dy1 and on the upper side of the third dynode Dy3. And a second focusing electrode for converging the secondary electrons to the third dynode Dy3 can be provided on the lower side of the second dynode Dy2 and on the upper side of the third dynode Dy3. The first and second focusing electrodes can be made integral to each other from a same material. Alternatively, The first and second focusing electrodes can be made separately from different materials.

The shield electrodes 11 and 110 can be made without a rise. The shape of the aperture in the shield electrode 110 is not limited to a rectangular shape. The shield electrodes 11 and 110 can be omitted. Therefore, it is possible to reduce an amount of the material to make the shield electrodes 11 and 110, thereby reducing manufacturing costs.

The number of space segments 5-1 to 5-4 is not restricted to four, for example, the number of space segments can be nine consisting of a 3×3 matrix. In the latter case, the partitioning wall 9 can be provided in a grid manner depending on the arrangement of the space segments.

The aperture in the flat electrode 13 is not always provided with a mesh 15. Further, the vertical, horizontal, and diagonal portions of the first dynode Dy1 and the second dynode Dy2 can have a curved structure instead of a flat structure.

The third dynode Dy3 need not extend beyond the first screen 21 towards the side tube 6. The third dynode Dy3 extends at least to a point below the first screen 21.

In the preferred embodiments, the dynode array 25 consists of a third to tenth dynodes. In another embodiment, the dynode array can have more or less than eight dynodes.

In the preferred embodiments, the dynode array 25 was described as a Venetian blind type. The dynode array can be a laminated structure dynode array such as a fine mesh, or a microchannel plate type. A box type or a linear-focus type dynodes can be used as a dynode as the third and higher order dynodes.

The shape of the glass container 5 is not restricted to be prismatic but can be cylindrical.

The partitioning wall 109 in the multi-anode type photomultiplier tube 100 can be replaced with the partitioning wall 9.

In the above embodiments, the descriptions are made for explaining the multi-anode type photomultiplier tubes 1 and 100 having the four space segments 5-1 to 5-4. However, the present invention is not limited to the photomultiplier tube having the above configurations. The present invention can be applied to a photomultiplier tube having a single space segments. In this case, the third and higher order dynodes can be extended up to the outside of the apertures 24 or 124.

INDUSTRIAL APPLICABILITY

The photomultiplier tube of the present invention can be employed as positron CTs in the medical field. Further, the photomultiplier of the present invention can be used in a wide range of fields in order to detect radiation and light.

What is claimed is:

1. A photomultiplier tube comprising:

a faceplate made from glass having a surface;

a side tube made from glass and having a hollow shape extending in a tube axial direction which is substantially perpendicular to the faceplate, the side tube being joined to of the faceplate;

a photocathode formed on the surface of the faceplate in the side tube to emit a photoelectron in response to light incident on the faceplate;

an electron multiplying portion provided in the side tube for multiplying the photoelectron emitted from the photocathode; and an anode provided inside the side tube for receiving an electron emitted from the electron multiplying portion, wherein the electron multiplying portion includes:

a first dynode placed at a position in the tube axial direction for multiplying the photoelectron impinging thereon from the photocathode to emit a secondary electron, the first dynode having a proximal end which is close to the anode;

a second dynode placed at a substantially same position as the position of the first dynode in the tube axial direction, the second dynode multiplying the secondary electrons impinging thereon from the first dynode to emit a secondary electron, the second dynode having a proximal end which is close to the anode;

a third dynode provided on an anode side of the first and second dynodes in the tube axial direction for multiplying the secondary electrons impinging thereon from the second dynode to emit secondary electrons; and a focusing electrode having:

a flat plate provided between the second and third dynodes, the flat plate having an aperture that enables the third dynode to face the second dynode;

a first screen provided on a first dynode side of the aperture, the first screen extending across the proximal end of the first dynode toward the photocathode; and a second screen provided on a second dynode side of the aperture, the second screen extending towards the photocathode so that a front end thereof is positioned between the proximal end of the second dynode and the photocathode, the first screen and second screen being located between the proximal end of the first dynode and the proximal end of the second dynode in a direction perpendicular to the tube axial direction.

2. The photomultiplier tube according to claim 1, wherein the focusing electrode is maintained at a potential which is higher than a potential of the second dynode and lower than a potential of the third dynode.

3. A photomultiplier tube comprising:

a faceplate made from glass having a surface;

a side tube made from glass and having a hollow shape extending in a tube axial direction which is substantially perpendicular to the faceplate, the side tube being joined to of the faceplate;

a photocathode formed on the surface of the faceplate in the side tube to emit a photoelectron in response to light incident on the faceplate;

an electron multiplying portion provided in the side tube for multiplying the photoelectron emitted from the photocathode; and an anode provided inside the side tube for receiving an electron emitted from the electron multiplying portion, wherein the electron multiplying portion includes:

a first dynode placed at a position in the tube axial direction for multiplying the photoelectron impinging thereon from the photocathode to emit a secondary electron, the first dynode having a proximal end which is close to the anode;

a second dynode placed at a substantially same position as the position of the first dynode in the tube axial direction, the second dynode multiplying the secondary electrons impinging thereon from the first dynode to emit a secondary electron, the second dynode having a proximal end which is close to the anode;

a third dynode provided on an anode side of the first and second dynodes in the tube axial direction for multiplying the secondary electrons impinging thereon from the second dynode to emit secondary electrons; and a focusing electrode having:

a first screen formed on a proximal end side of the first dynode and extending across the proximal end of the first dynode toward the photocathode;

a flat plate having a cut-away portion that enables the third dynode to face the second dynode; and a second screen provided at the cut-away portion on a proximal end side of the second dynode, the second screen extending across the proximal end of the second dynode towards the photocathode, the focusing electrode being secured between the second and third dynodes, thereby defining a space extending from the first dynode to the third dynode, the first screen and the second screen being located between the proximal end of the first dynode and the proximal end of the second dynode in a direction perpendicular to the tube axial direction.

4. The photomultiplier tube according to claim 3, wherein the focusing electrode is maintained at a potential which is higher than a potential of the second dynode and lower than a potential of the third dynode.

5. A photomultiplier tube comprising:

a faceplate made from glass having a surface;

a side tube made from glass and having a hollow shape extending in a tube axial direction which is substantially perpendicular to the faceplate, the side tube being joined to of the faceplate;

a photocathode formed on the surface of the faceplate in the side tube to emit a photoelectron in response to light incident on the faceplate;

an electron multiplying portion provided in the side tube for multiplying the photoelectron emitted from the photocathode; and an anode provided inside the side tube for receiving an electron emitted from the electron multiplying portion, wherein the electron multiplying portion includes:

a first dynode placed at a position in the tube axial direction for multiplying the photoelectron impinging thereon from the photocathode to emit a secondary electron, the first dynode having a proximal end which is close to the anode;

a second dynode placed at a substantially same position as the position of the first dynode in the tube axial direction, the second dynode multiplying the secondary electrons impinging thereon from the first dynode to emit a secondary electron, the second dynode having a proximal end which is close to the anode;

a third dynode provided on an anode side of the first and second dynodes in the tube axial direction for multiplying the secondary electrons impinging thereon from the second dynode to emit secondary electrons; and a focusing electrode having:

a first screen formed on a proximal end side of the first dynode and extending across the proximal end of the first dynode toward the photocathode;

a flat plate provided between the second and third dynodes, the flat plate having a first cut-away portion that enables the third dynode to face the second dynode and a second cut-away portion formed between the first and third dynodes; and a second screen provided on a second dynode side of the first cut-away portion and extending across the proximal end of the second dynode towards the photocathode, the first screen and the second screen being located between the proximal end of the first dynode and the proximal end of the second dynode in a direction perpendicular to the tube axial direction.

6. The photomultiplier tube according to claim 5, wherein the focusing electrode is maintained at a potential that is higher than a potential of the second dynode and lower than a potential of the third dynode.

7. A photomultiplier tube comprising:

a faceplate made from glass having a surface;

a side tube made from glass and having a hollow shape extending in a tube axial direction which is substantially perpendicular to the faceplate, the side tube being joined to of the faceplate;

a photocathode formed on the surface of the faceplate in the side tube to emit a photoelectron in response to light incident on the faceplate;

an electron multiplying portion provided in the side tube for multiplying the photoelectron emitted from the photocathode; and an anode provided inside the side tube for receiving an electron emitted from the electron multiplying portion, wherein the electron multiplying portion includes:

a first dynode placed at a position in the tube axial direction for multiplying the photoelectron impinging thereon from the photocathode to emit a secondary electron, the first dynode having a proximal end which is close to the anode;

a second dynode placed at a substantially same position as the position of the first dynode in the tube axial direction, the second dynode multiplying the secondary electrons impinging thereon from the first dynode to emit a secondary electron, the second dynode having a proximal end which is close to the anode;

a third dynode provided on an anode side of the first and second dynodes in the tube axial direction for multiplying the secondary electrons impinging thereon from the second dynode to emit secondary electrons; and a first focusing electrode provided on an anode side of the first dynode and on a photocathode side of the third dynode; and a second focusing electrode provided on an anode side of the second dynode and on a photocathode side of the third dynode; and wherein an electron multiplied by the second dynode travels in a space between the fist and second focusing electrodes to impinge on the third dynode, the first focusing electrode and the second focusing electrode being located between the proximal end of the first dynode and the proximal end of the second dynode in a direction perpendicular to the tube axial direction.

8. The photomultiplier tube according to claim 7, wherein the first focusing electrode is integral with the second focusing electrode.

* * * * *